US011357346B1

(12) United States Patent
Illulian et al.

(10) Patent No.: US 11,357,346 B1
(45) Date of Patent: Jun. 14, 2022

(54) COLLAPSIBLE GROUND SHEET

(71) Applicant: Sandy Bumz, LLC, Los Angeles, CA (US)

(72) Inventors: David Illulian, Los Angeles, CA (US); Kiarash Illulian, Los Angeles, CA (US)

(73) Assignee: SANDY BUMZ, LLC, Los Angeles, CA (US)

( * ) Notice: Subject to any disclaimer, the term of this patent is extended or adjusted under 35 U.S.C. 154(b) by 0 days.

(21) Appl. No.: 17/471,629

(22) Filed: Sep. 10, 2021

(51) Int. Cl.

| | |
|---|---|
| ***A47G 9/06*** | (2006.01) |
| *A47D 13/06* | (2006.01) |
| *A47D 15/00* | (2006.01) |
| *E04H 15/40* | (2006.01) |
| *E04H 15/56* | (2006.01) |

(52) U.S. Cl.
CPC ..... *A47G 9/062* (2013.01); *A47D 13/06* (2013.01); *A47D 13/061* (2013.01); *A47D 13/063* (2013.01); *A47D 15/003* (2013.01); *A47G 9/06* (2013.01); *E04H 15/40* (2013.01); *E04H 15/56* (2013.01)

(58) Field of Classification Search
CPC ..... A47G 9/06; A47G 9/062; E04H 15/56; E04H 15/40; A47D 13/06; A47D 13/061; A47D 13/063; A47D 15/003
USPC ..... 135/116, 126
See application file for complete search history.

(56) References Cited

U.S. PATENT DOCUMENTS 1,624,797 A * 4/1927 Morehouse ..... A47C 27/00 5/417
3,537,116 A * 11/1970 Kain ..... A47G 9/0246 5/420
4,205,684 A * 6/1980 Lassy ..... A61N 5/06 607/95
4,599,754 A * 7/1986 Mairs, III ..... A47G 9/06 135/96
4,788,726 A * 12/1988 Rafalko ..... A47D 5/006 5/424
4,860,777 A * 8/1989 Orlando ..... E04H 15/003 135/87
4,969,500 A * 11/1990 Makosa ..... E04H 15/003 135/902
4,981,152 A * 1/1991 Laurent ..... E04H 15/003 135/117
5,054,507 A * 10/1991 Sparks ..... E04H 15/003 135/97

(Continued)

OTHER PUBLICATIONS

Photos of six-sided "Sandy Bumz" product (2016).

*Primary Examiner* — Peter M. Cuomo
*Assistant Examiner* — Rahib T Zaman
(74) *Attorney, Agent, or Firm* — Notaro, Michalos & Zaccaria P.C.

(57) ABSTRACT

A collapsible ground sheet has a floor made of a sheet of flexible, waterproof or water-resistant material, and walls attached to the floor and extending from the floor in a top direction. The walls are arranged about the periphery of the floor in series in a ring formation such that each of the walls has two neighboring walls. Each wall has a fabric portion and a wire loop, the wire loop disposed near the periphery of the fabric portion such that the fabric portion is supported by the wire loop. Each of the walls attached to its two neighboring walls by hourglass-shaped gussets made of a sheet of flexible material.

8 Claims, 5 Drawing Sheets

(56) References Cited

U.S. PATENT DOCUMENTS 5,085,212 A * 2/1992 DeCosta ..... E04H 15/003 4/526
5,115,524 A * 5/1992 Antosko ..... A47D 9/005 229/103
5,134,815 A * 8/1992 Pickett ..... E01F 8/0023 405/285
5,187,823 A 2/1993 Ferguson
5,195,828 A 3/1993 Bush
5,351,348 A * 10/1994 Beger ..... A47D 5/006 5/420
5,375,275 A * 12/1994 Sanders ..... A47K 3/286 4/599
5,595,230 A * 1/1997 Guerra ..... E01F 7/00 160/135
5,711,336 A * 1/1998 Nirmel ..... E04H 15/003 135/87
5,948,250 A * 9/1999 Middleton ..... C02F 1/40 210/232
6,092,792 A * 7/2000 Camara ..... E04H 15/003 135/87
6,269,826 B1 * 8/2001 Zheng ..... A63B 9/00 135/117
6,289,910 B1 * 9/2001 Zheng ..... A63B 9/00 135/125
6,305,396 B1 * 10/2001 Zheng ..... A63B 9/00 135/115
6,357,510 B1 * 3/2002 Zheng ..... A63B 9/00 135/143
6,393,639 B1 * 5/2002 Ohsner ..... A47D 5/006 5/425
6,408,463 B1 * 6/2002 Palacio ..... A47D 13/066 5/424
6,560,095 B1 * 5/2003 Zheng ..... A63B 9/00 135/91
6,634,040 B2 10/2003 LeGette
6,694,994 B1 * 2/2004 Zheng ..... A63H 33/008 135/117
7,156,250 B2 * 1/2007 Tillmann ..... A47D 13/02 220/9.2
7,216,381 B1 * 5/2007 Setzer ..... E04B 2/7425 160/135
7,263,732 B2 9/2007 Zheng
7,661,160 B1 2/2010 Adams
7,699,186 B2 * 4/2010 Zheng ..... E04H 15/405 220/565
8,001,638 B1 * 8/2011 Quinter ..... A47D 15/001 5/722
8,740,006 B2 * 6/2014 Matson ..... F16N 31/00 220/571
9,173,493 B1 * 11/2015 Fulton ..... A47C 7/72
9,259,108 B2 * 2/2016 Snep ..... A47G 9/062
9,492,023 B2 * 11/2016 Paulat ..... A47G 9/062
10,010,463 B1 * 7/2018 King ..... A47K 3/062
10,604,960 B1 * 3/2020 Hulsey ..... E04H 15/001
10,918,223 B2 * 2/2021 Goodwin ..... A47D 15/008
11,178,987 B2 * 11/2021 Novacek ..... A47C 17/645
2004/0139997 A1 * 7/2004 Zheng ..... E04H 4/0025 135/126
2004/0168714 A1 * 9/2004 Zheng ..... E04H 15/14 135/87
2007/0039640 A1 * 2/2007 Zheng ..... E04H 15/40 135/126
2008/0052827 A1 * 3/2008 DeIntinis ..... A45F 3/02 5/417
2009/0007337 A1 * 1/2009 Mese ..... A47D 15/008 5/655
2009/0321503 A1 * 12/2009 Barnes ..... A45C 7/0095 229/103
2010/0186165 A1 * 7/2010 Marciano ..... A47C 17/64 5/419
2013/0008617 A1 * 1/2013 Rivera ..... E04H 15/005 160/127
2015/0059091 A1 3/2015 Jung
2016/0088953 A1 * 3/2016 Benezri ..... A45F 4/00 224/261
2017/0020251 A1 * 1/2017 Rothschild ..... A45F 4/02
2017/0055736 A1 * 3/2017 Coffey ..... A47G 9/062
2020/0008594 A1 * 1/2020 Novacek ..... A47C 17/645

* cited by examiner

Dimension of case:
Length: 34 inches
Width: 9.5 inches
Thickness: 3/4 inches

COLLAPSIBLE GROUND SHEET

FIELD AND BACKGROUND OF THE INVENTION

The subject technology relates to ground sheets or ground covers for placing on a ground surface, for example, on beach sand or on grass.

Ground covers, for example, beach blankets and picnic blankets, are used to cover an area of ground to provide a clean and convenient barrier for users to sit or lie upon. A traditional beach or picnic blanket has a relatively large area to accommodate several people comfortably. Traditional blankets of this nature are usually made of a thick, bulky material, such as terrycloth. These blankets are bulky and cumbersome to deploy on the ground, to transport and store, and to prepare for transportation and storage by folding or rolling. Additionally, although traditional beach blankets provide some protection from contact with the beach or ground, there is no provision to prevent sand or dirt from being blown by the wind onto the surface of the blanket and onto the persons using the blanket.

There is a need for a ground cover that is lightweight, and that is easy to deploy, transport and store, and easy to prepare for transport and storage; and which also provides a barrier or protection against sand, dust and dirt blown by the wind.

SUMMARY OF THE INVENTION

According to an aspect of the subject technology, a collapsible ground sheet, ground cover, or beach blanket is made of a lightweight material and is configured and adapted to be folded into a convenient configuration which can be kept in a lightweight storage bag adapted for that purpose. The collapsible ground sheet includes resilient memory wire structures which exert a force tending to deploy the ground cover when removed from the storage bag and manipulated by the user. The memory wire structures also support walls disposed about the ground sheet to protect the user from sand, dust and dirt blown by the wind.

In a non-limiting embodiment, a collapsible ground sheet comprises a floor made of a sheet of flexible, waterproof or water-resistant material, the floor having a periphery and a top direction. Walls are attached to the floor and extend from the floor in the top direction, and are arranged about the periphery of the floor, in series, in a ring formation such that each of the walls has two neighboring walls. Each of the walls comprises a fabric portion and a wire loop, the wire loop disposed near the periphery of the fabric portion such that the fabric portion is supported by the wire loop. The wire support is attached to the fabric portion with bias tape stitched to the fabric portion, or is otherwise attached. Each of the walls attached to its two neighboring walls by hourglass-shaped gussets made of a sheet of flexible material.

Preferably, the ground sheet has more than six walls, for improved stability when deployed. In a non-limiting embodiment, the ground sheet has eight walls.

Each of the walls has a length and a height. In a non-limiting embodiment, the ratio of length to height is in the range of 3.8 to 4.2, or is approximately 4, or is 4. In a non-limiting embodiment, the length is approximately 32 inches and the height is approximately 8 inches.

The collapsible ground sheet of the subject technology has numerous use cases. It can be used as a beach blanket, a picnic blanket, a ground cover when camping, or in a home as an infant and toy corral.

The various features of novelty which characterize the subject technology are pointed out with particularity in the claims annexed to and forming a part of this disclosure. For a better understanding of the subject technology, its operating advantages and specific objects attained by its uses, reference is made to the accompanying drawings and descriptive matter in which preferred embodiments of the subject technology are illustrated.

DETAILED DESCRIPTION OF THE INVENTION

Figure 1:
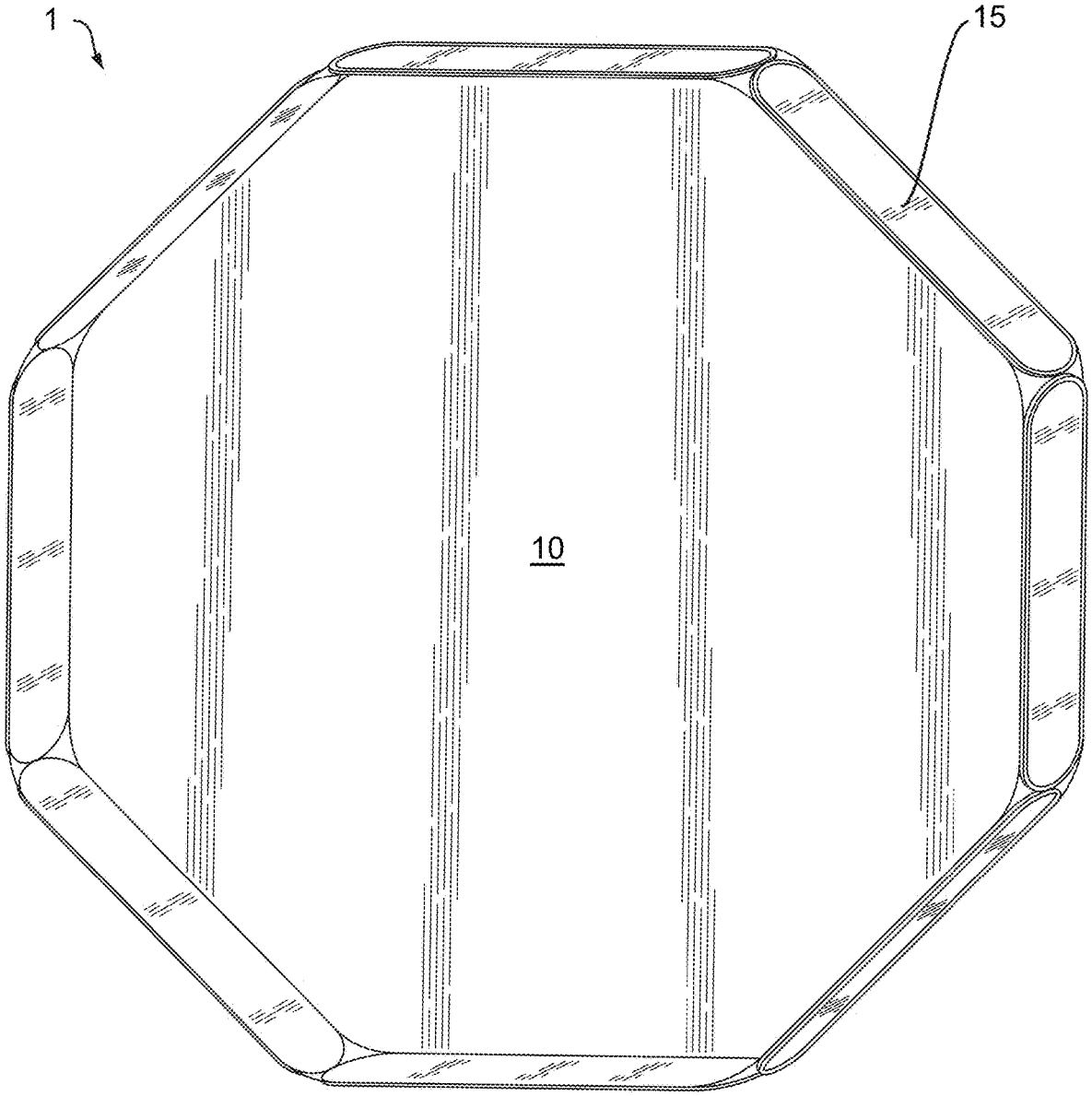
FIG. 1 is a perspective view of a ground sheet according to a non-limiting embodiment of the subject technology.
Figure 2:
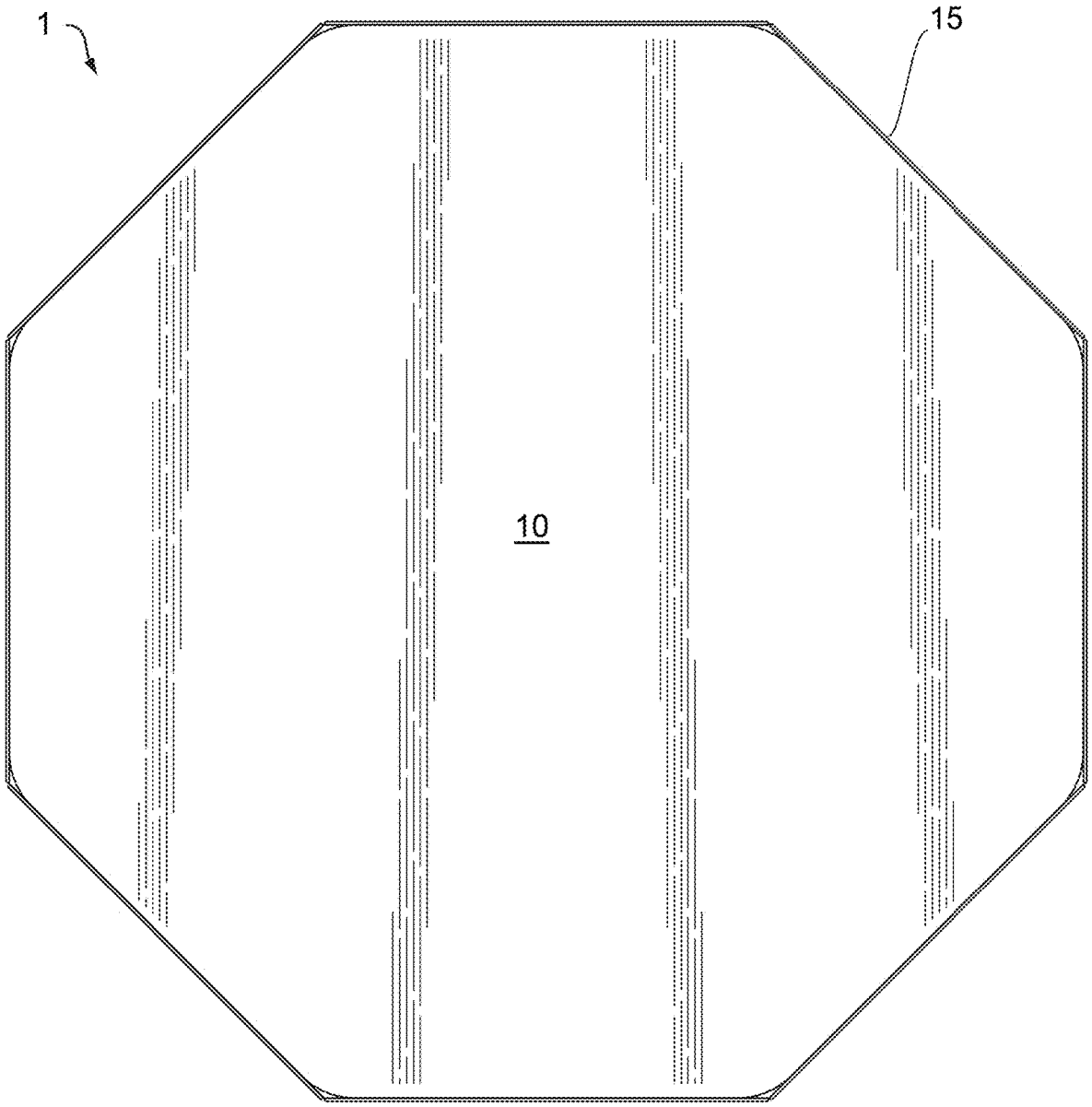
FIG. 2 is a top plan view of a ground sheet according to a non-limiting embodiment of the subject technology.
Figure 3:
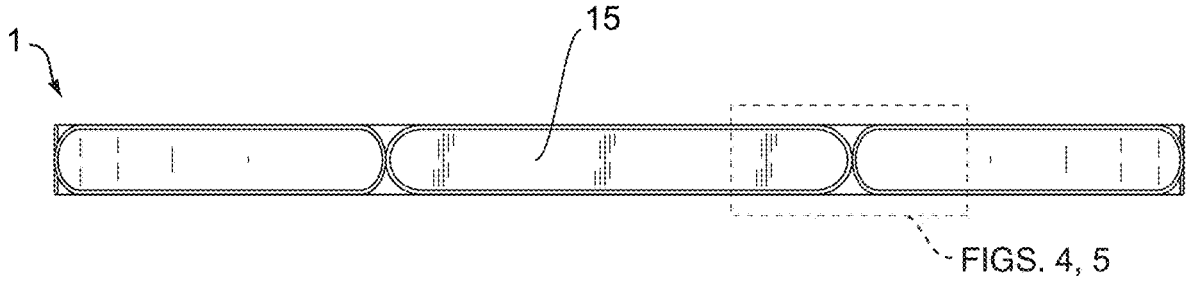
FIG. 3 is an elevation view of a ground sheet according to a non-limiting embodiment of the subject technology.
Figure 4:
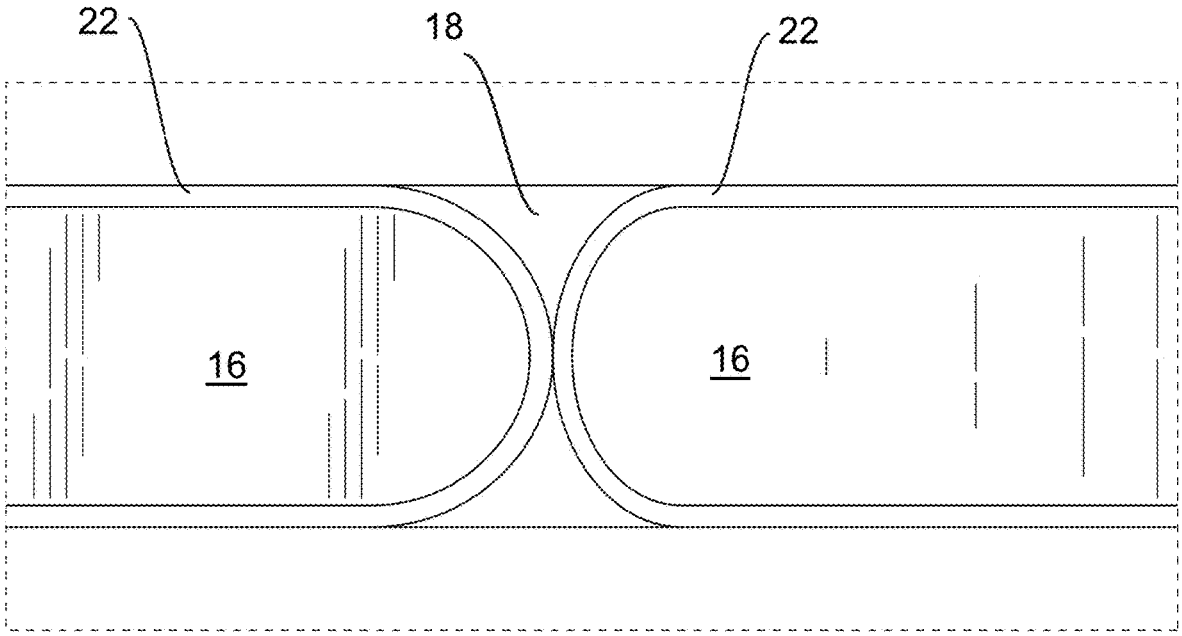
FIG. 4 is a side, detail view of a ground sheet according to a non-limiting embodiment of the subject technology.
Figure 5:
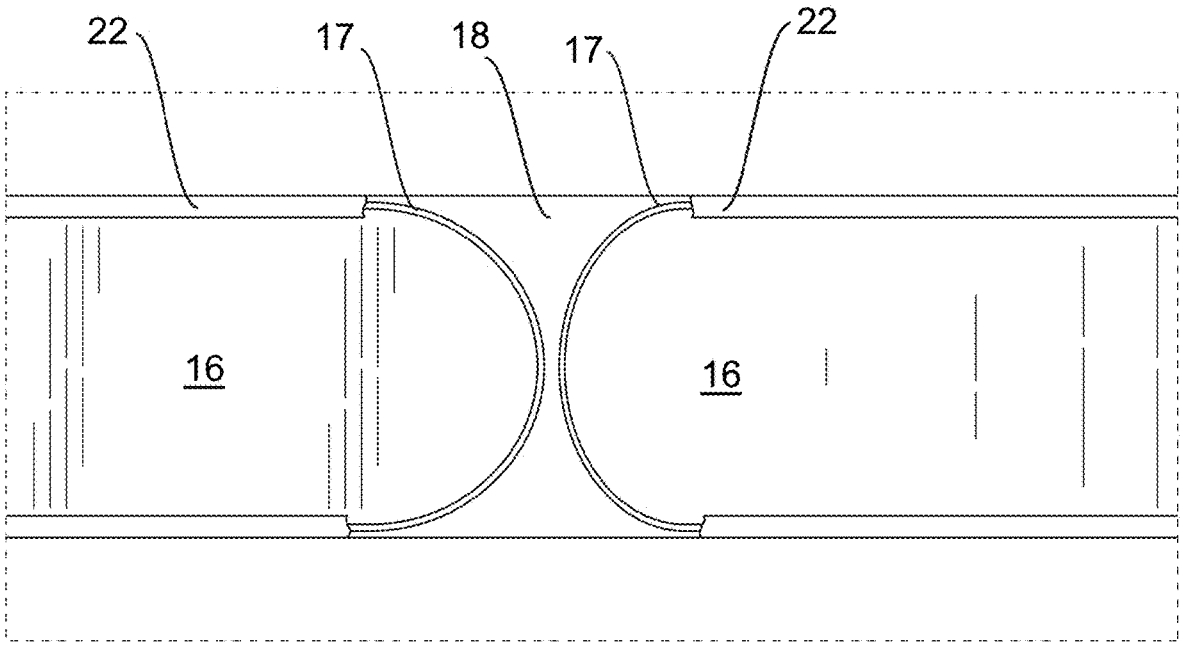
FIG. 5 is the view of FIG. 3 with bias tapes partially removed to show the wire supports beneath the bias tapes.

According to a non-limiting aspect of the subject technology, as shown in Figures, ground cloth 1 comprises a floor 10 and walls 15 (only one is numbered in the Figures). Walls 15 are attached near a bottom portion thereof to a periphery of floor 10 by, for example, stitching.

In an embodiment, floor 10 is made of a strong, flexible sheet of material, preferably waterproof or water-resistant material, non-limiting examples being synthetic fabric (for example nylon or polyester fabric), laminated fabric (i.e. a fabric base layer with a waterproof or water resistant layer or layers laminated to the fabric), vinyl, linen, oilcloth, wool, Gore-Tex® or canvas.

Walls 15 are similar to each other in construction and comprise a fabric portion 16, which preferably is a strong, flexible sheet of material as previously described, and may be the same material as floor 10. Each wall 15 further comprises a support 17, which in an embodiment is a long loop of wire, for example steel wire, disposed near a periphery of fabric portion 16. In an embodiment, support 17 is a loop of resilient steel wire, for example, memory wire. In an embodiment, support 17 is steel memory wire having cross-sectional dimensions of 1 mm×3 mm. Support 17 is connected to fabric portion 16 of wall 15 and disposed to support it in a substantially vertical position when ground cloth 1 is deployed on a ground surface. In an embodiment in which support 17 is a loop of wire, support 17 is disposed as shown near a periphery of fabric portion 16. In this embodiment, support 17 may be attached to fabric portion 16 by a bias tape 22 overlying support 17 and attached to fabric portion 16 about its periphery, for example, overlapping the edge of fabric portion 16 and overlying support 17, and stitched to fabric portion 16, thereby enclosing support 17 within the bias tape 22 and holding support 17 in its position near the periphery of fabric portion 16. Other structures for attaching support 17 to fabric portion 16 are possible and are within the scope of the subject technology.

Each wall 15 is joined to its neighboring walls to provide mutual support when ground cloth 1 is deployed on a ground surface. In an embodiment, walls 15 are joined by hourglass-shaped gusset 18, which may be of the same material as the floor 10 and fabric portions 16, stitched to the neighboring walls 15 and to the floor 10, thereby joining them together by a flexible connection.

In an embodiment, ground cover 1 is configured as a regular polygon, for example an octagon. In this embodiment, floor 10 has the shape of the polygon, for example an octagonal shape, and when deployed, walls 15, being attached to the edges of the octagonally-shaped floor 10, and supported by supports 17 and the gussets 18, stand in a substantially vertical position about the octagon, so that the overall configuration of the ground cover 1 is octagonal in this embodiment.

Figure 6:
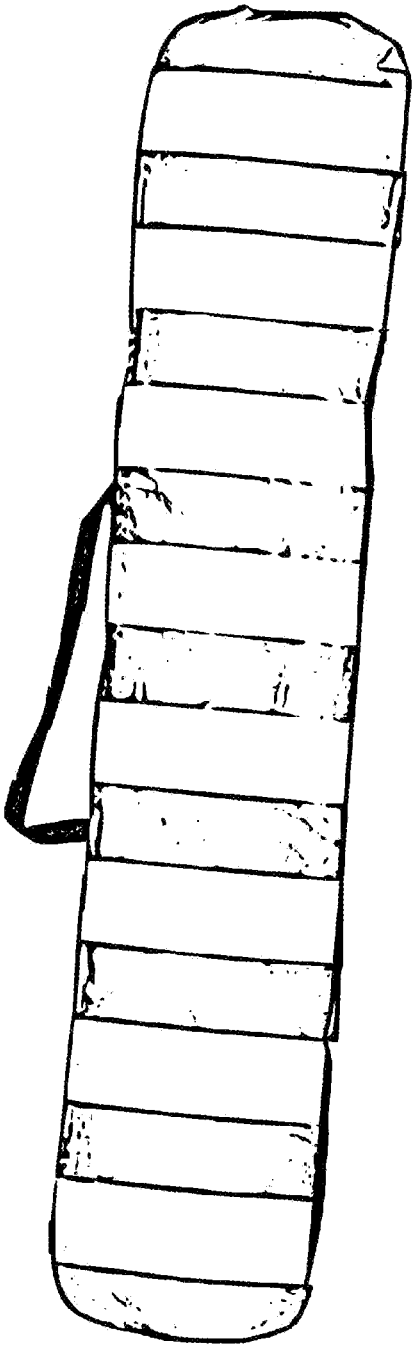
FIG. 6 is a photograph of the encased ground sheet according to a non-limiting embodiment of the subject technology.

Due to its structure as described, ground cloth 1 can be easily collapsed and folded up for transport and stored in a carrying bag for that purpose. When folded, the walls 15 generally overlie each other while individual walls 15 are not themselves folded, rather the flexible floor 10 and gussets 18 are flexed and folded manually until the walls 15 are overlying each other in a stack to form a compact, relatively flat configuration that can be placed in the carrying bag. In a non-limiting embodiment, as seen in FIG. 6, the carrying bag including the collapsed ground cloth has the following dimensions: length 34 in., width 9.5 in., thickness ¾ in. In this folded configuration, while encased, the wire members may be temporarily bent slightly. The resiliency of the bent wire support members tends to exert a force which deploys the ground cloth 1 when it is removed from its carrying bag and manipulated to allow the ground cloth 1 to expand to its deployed state.

The fabric material used for the floor and walls may be thinner and lighter than a traditional beach blanket, and thus the subject ground sheet is a lightweight alternative. An embodiment of ground sheet 1 weighs about three pounds and can easily be carried to the beach or park by a young person.

Walls 15 each have a height 19 and a length 20 (which length 20 is measured along the longest axis of a wall 15, as shown). Height 19 is preferably high enough to reduce the amount of sand or other debris that is swept into the ground cloth by winds, etc. In an embodiment, height 19 is 8 inches or approximately 8 inches. ("Approximately" is used throughout to denote plus or minus 10%.) The length 20 is preferably such that the area of floor 10 is sufficient for the purpose of use as a ground cloth for one or more persons. In an embodiment, length 20 is 32 inches or approximately 32 inches, such that the area of floor 10 (in an octagonal embodiment) is 4,944 in^2.

The inventors have discovered in practice that the ratio of length 20 to height 19 is important in the performance of ground cloth 1 when deployed. For example, if the length-to-height ratio is too high, the walls 15 lack stability in use and tend to sag or flop over to one side rather than standing in an approximately vertical position as desired. In the octagonal embodiment described above, the length-to-height ratio is 4, which the inventors have discovered yields good results. A hexagonal ground sheet having a comparable area, with a wall length of 45 in and wall height of 8 inches (ratio 5.6), was found by the inventors to suffer from the problem of unstable walls. In various embodiments of the subject technology, the length-to-height ratio is 4, or approximately 4, or in the range of 3.8 to 4.2.

Similarly, the inventors have discovered that the internal angle of the polygon has an effect on wall stability. The inventors have discovered that a polygon with more than six sides, for example, an octagon results in a more stable product than a hexagon.

While specific embodiments of the invention have been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention.

What is claimed is:

1. A collapsible ground sheet comprising:

a floor made of a sheet of flexible, waterproof or water-resistant material, the floor having a periphery and a top direction;

a plurality of walls attached to the floor and extending from the floor in the top direction, and arranged about the periphery of the floor in series in a ring formation such that each of the walls has two neighboring walls;

each of the walls comprising a fabric portion and a wire loop, the wire loop disposed near the periphery of the fabric portion such that the fabric portion is supported by the wire loop; and each of the walls attached to its two neighboring walls by hourglass-shaped gussets made of a sheet of flexible material;

wherein the plurality of walls comprises more than six walls;

wherein each of the walls has a length and a height, wherein the ratio of length to height is in the range of 3.8 to 4.2.

2. The collapsible ground sheet of claim 1 wherein each of the walls has a length and a height, wherein the ratio of length to height is approximately 4.

3. A collapsible ground sheet comprising:

a floor made of a sheet of flexible, waterproof or water-resistant material, the floor having a periphery and a top direction;

a plurality of walls attached to the floor and extending from the floor in the top direction, and arranged about the periphery of the floor in series in a ring formation such that each of the walls has two neighboring walls;

each of the walls comprising a fabric portion and a wire loop, the wire loop disposed near the periphery of the fabric portion such that the fabric portion is supported by the wire loop; and each of the walls attached to its two neighboring walls by hourglass-shaped gussets made of a sheet of flexible material;

wherein the plurality of walls comprises more than six walls;

wherein each of the walls has a length of approximately 32 inches and a height of approximately 8 inches.

4. The collapsible ground sheet of claim 1 wherein the material is synthetic fabric, laminated fabric, vinyl, linen, oilcloth, wool, or canvas.

5. The collapsible ground sheet of claim 1 wherein the fabric portion of the walls is made of the same material as the floor.

6. The collapsible ground sheet of claim 1 wherein the fabric portion of the walls is made of the same material as the floor.

7. The collapsible ground sheet of claim 1 wherein the wire support is attached to the fabric portion with bias tape.

8. The collapsible ground sheet of claim 1 wherein the plurality of walls consists of exactly eight walls.

* * * * *